United States Patent [19]

Rawlings

[11] 4,449,325

[45] May 22, 1984

[54] ADJUSTABLE WINDOW ASSEMBLY

[75] Inventor: David E. Rawlings, Cheltenham, England

[73] Assignee: Consort Aluminium Limited, Tewkesbury, England

[21] Appl. No.: 393,624

[22] Filed: Jun. 29, 1982

[51] Int. Cl.[3] ..... E05D 15/52

[52] U.S. Cl. ..... 49/192

[58] Field of Search ..... 49/192, 193, 246, 248, 49/249, 250, 251, 252

[56] References Cited

U.S. PATENT DOCUMENTS

| | | | |
|---|---|---|---|
| 2,337,632 | 12/1943 | Winser | 49/193 X |
| 2,604,674 | 7/1952 | Johnson | 49/193 X |
| 3,101,135 | 8/1963 | Neal et al. | 49/248 |
| 3,345,777 | 10/1967 | Anderberg et al. | 49/248 |

FOREIGN PATENT DOCUMENTS

| | | | |
|---|---|---|---|
| 547977 | 9/1942 | United Kingdom . | |
| 554764 | 7/1943 | United Kingdom . | |
| 579707 | 8/1946 | United Kingdom . | |
| 931713 | 7/1963 | United Kingdom . | |
| 1228259 | 4/1971 | United Kingdom . | |
| 45009 | 2/1982 | European Pat. Off. . | |
| 2940049 | 5/1981 | Fed. Rep. of Germany | 49/192 |
| 188825 | 4/1937 | Switzerland | 49/246 |

*Primary Examiner*—Philip C. Kannan

*Attorney, Agent, or Firm*—Young & Thompson

[57] ABSTRACT

A window assembly comprises an open rectangular frame which, in use, is fixed, and a rectangular vent which is movable into and out of engagement with the open frame. The vent is connected to the open frame by a plurality of extensible friction linkages so arranged that the vent may be selectively adjusted angularly with respect to the frame by differential extension of at least certain of the linkages.

3 Claims, 10 Drawing Figures

ADJUSTABLE WINDOW ASSEMBLY

BACKGROUND OF THE INVENTION

The invention relates to windows and provides a window assembly which is particularly suitable for use as a secondary window, that is to say a window assembly designed to be fitted internally of the existing, primary windows of a building, so as to provide double glazing without the necessity of replacing the primary windows. It is desirable for such secondary windows to be unobtrusive, to provide a good seal in order to give the benefits of double glazing, and yet to be openable for cleaning and for ventilation. Various types of secondary windows are in common use but all have certain disadvantages.

In the simplest form of secondary window, the glass panel is simply clipped into a frame and must be bodily lifted out of the frame for cleaning and ventilation. Not only is this inconvenient but there is obviously considerable risk of breakage. Some secondary windows are side hinged in similar manner to primary windows but while this may be convenient for cleaning and ventilation the fixed and movable frames require to be fairly substantial and, due to its weight, there is a practical limit to the size of such a window. Vertically or horizontally sliding secondary windows are also commonly employed, but here there may be difficulty in cleaning the windows.

The present invention sets out to provide a window assembly which allows, in a convenient manner, great variation in the form of ventilation provided by the window, ease of operation, and ease of cleaning. Although the invention is particularly suitable for secondary windows, it will be apparent that the arrangement may also be used for primary windows if required.

The assembly according to the invention may be mounted in a vertical plane, in the normal manner of a primary or secondary window, but it may also, if required, be mounted at an angle to the vertical, or horizontally, for example when used s a skylight.

Although throughout this specification the expression "window assembly" will be used, for convenience, it will be appreciated that the invention is not limited to arrangements in which the vent is transparent or translucent, and is equally applicable to assemblies where the movable vent is opaque, for example for use as a ventilator or shutter. It is to be understood, therefore, that the expression "window assembly", where used in this specification, includes such arrangements.

SUMMARY OF THE INVENTION

According to the invention there is provided a window assembly comprising an open frame which, in use, is fixed, and a vent which is movable into and out of engagement with the open frame, the vent being connected to the open frame by a plurality of extensible linkages so arranged that the vent may be selectively adjusted angularly with respect to the frame by differential extension of at least certain of the linkages. In the case where the frame and vent are rectangular, the linkages are preferably symmetrically disposed with respect thereto.

Thus, in use, the vent may be bodily displaced from the frame by extension of all the linkages so as to provide all round ventilation, and access to both sides of the glass for cleaning. In addition, however, since the vent may be adjusted angularly with respect to the frame by differential extension of the linkages, it may, in effect, be pivoted out of engagement with the frame about any of its four sides, whether vertical or horizontal. Alternatively, the vent may be both bodily displaced from the frame as well as being tilted in any direction. Such an arrangement permits great variation in the form of ventilation provided by the window.

Where the frame and vent are rectangular there may be provided four extensible linkages, two on each of two opposite sides of the assembly. Preferably the linkages are vertically spaced on the two vertical sides of the assembly.

Preferably some or all of the linkages are frictionally restrained, in known manner.

Conveniently, each linkage may comprise a known form of window supporting stay which is commonly used in windows where the vent is supported on two stays and is moved bodily away from the window frame as it is tilted. However, in this conventional manner of using such stays the vent is restricted to a predetermined range of movement due to the manner in which the stays are connected between the frame and the vent. The present invention provides an arrangement wherein each linkage is a window supporting stay of the kind comprising a track mounted on a side member of either the open frame or the vent so as to extend longitudinally thereof, a slider movable along the track, a strut pivotally connected to the track, a brace pivotally connected between the slider and the strut, a link pivotally connected to the slider, and a bar pivotally connected between the link and the strut and pivotally connected at its end either to the vent or to the open frame as the case may be, the arrangement being such that as the slider moves along the track the bar can swing from a position overlying, or at a small angle to , the track to a position where its angular displacement with respect to the track is increased.

It will be noted that in the above arrangement the end of the bar is pivotally connected either to the vent or to the frame. This differs from the normal method of mounting such stays in which the bar is rigidly secured to the vent so as to extend longitudinally of the side thereof, this limiting the range of possible movement of the vent with respect to the frame, as mentioned above.

DETAILED DESCRIPTION OF THE PREFERRED EMBODIMENT

Figure 1:
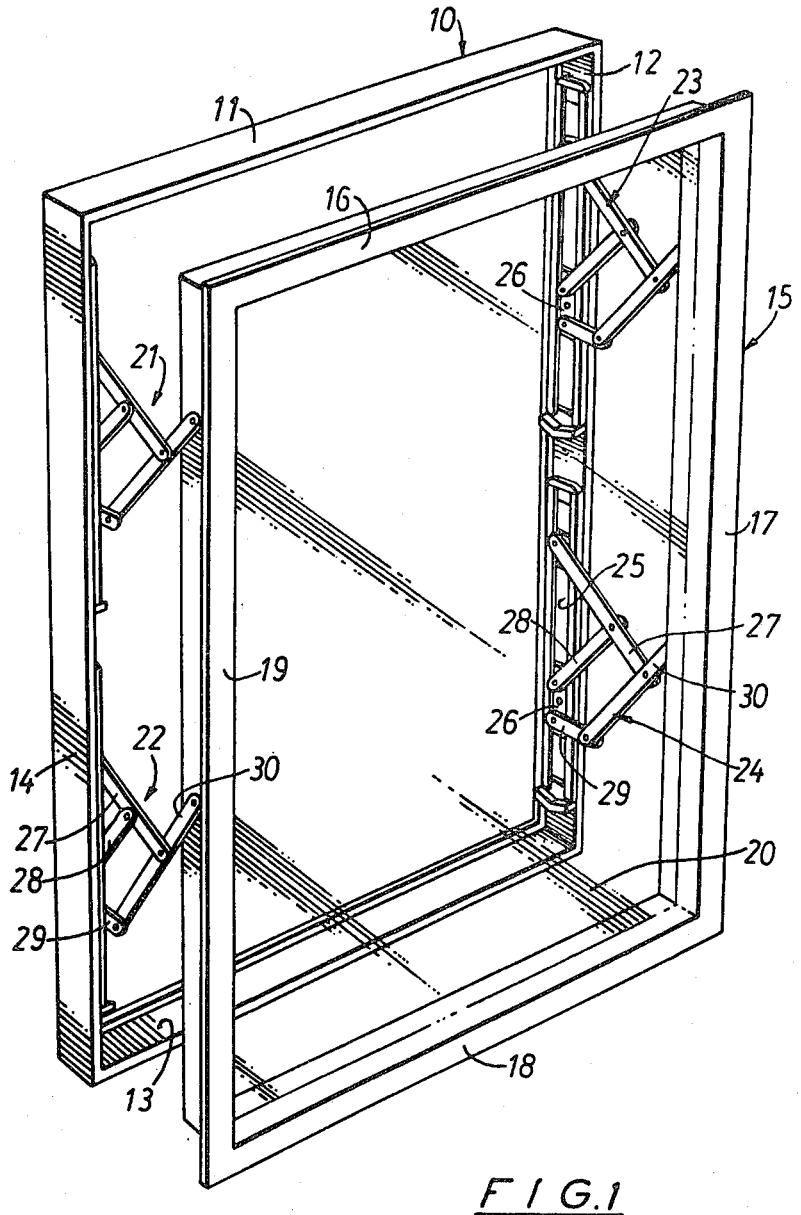
FIG. 1 is a diagrammatic perspective view of a window assembly according to the invention, in a partly opened position.
Figure 2A:
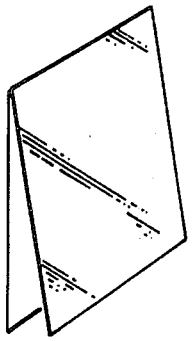
FIGS. 2(a) to 2(i) show diagrammatically various typical arrangements of the assembly in the open position.
Figure 2B:
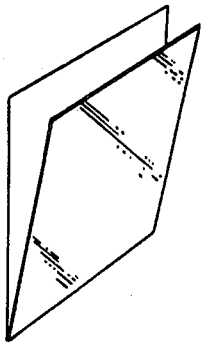
Figure 2C:
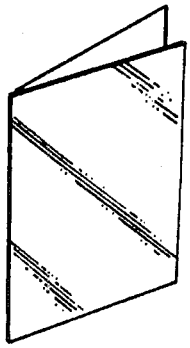
Figure 2D:
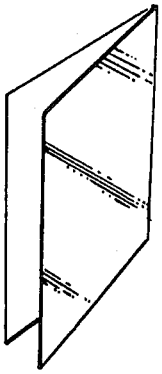
Figure 2E:
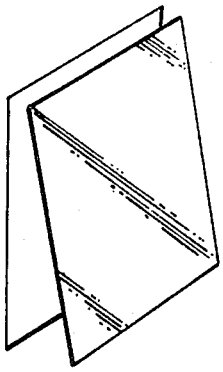
Figure 2F:
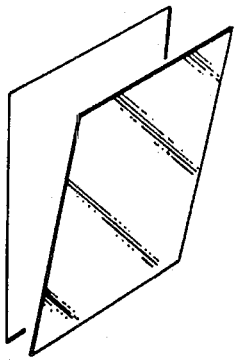
Figure 2G:
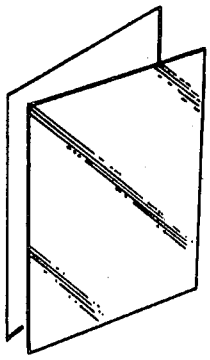
Figure 2H:
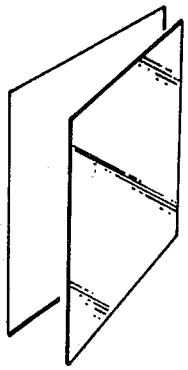
Figure 2I:
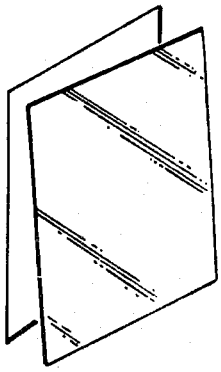

Referring to FIG. 1, the window assembly comprises a fixed open frame 10 formed from frame members 11, 12, 13 and 14. The frame members may conveniently be conventional aluminium extrusions mitred together at their corners such as are commonly used in modern window systems, although it will be appreciated that the principle of the invention is applicable to window frames formed from other metals as well as from wood or plastics.

The vent 15 similarly comprises an aluminium frame having frame members 16, 17, 18 and 19 in which a pane of glass 20 is mounted in conventional manner.

The vertical members of the frame 10 and vent 15 are interconnected by extensible linkages 21, 22, 23 and 24. The linkages are similar and symmetrically arranged and only one will be described in detail.

Each linkage comprises a commercially available form of friction window stay, but is not connected and used in the normal manner for such stays.

Each stay comprises a track 25 mounted on the side fram member 12 or 14 of the open frame 10 so as to extend longitudinally thereof, a slider 26 movable along the track 25, a strut 27 pivotally connected to the track 25, a brace 28 pivotally connected between the slider 26 and the strut 27, a link 29 pivotally connected to the slider 26, and a bar 30 pivotally connected between the link 29 and strut 27 and pivotally connected at its end to the side member 17 or 19 of the vent 15. As is well known, the arrangement of each stay is such that as the slider 26 moves along the track 25 the bar 30 can swing from a position overlying the track to a position where it is angled with respect to the track, as shown in FIG. 1.

As previously mentioned, in normal use of stays of this kind the bar 30 is fixedly secured to the side frame member of the vent and extends longitudinally thereof. Two parallel stays are mounted at opposite sides of the window assembly and operate simultaneously and in parallel so as to tilt the vent as it is moved into and out of engagement with the open frame.

In the arrangement according to the invention, however, since the end of the bar 30 of each stay is pivotally connected to the frame of the vent, differential extension and contraction of the individual stays can occur, thus permitting a large degree of angular adjustment of the vent, about all axes, with respect to the frame. Various alternative modes of operation of the assembly are shown diagrammatically in FIGS. 2(*a*) to 2(*i*).

With the vent initially in the fully closed position, it may be tilted about its upper horizontal edge to the position shown in FIG. 2(*a*), the lower stays 22 and 24 extending by a greater amount than the upper stays 21 and 23. Similarly in FIG. 2(*b*) the vent is pivoted about its lower horizontal edge, the upper stays 21 and 23 then extending more than the lower stays 22 and 24.

FIGS. 2(*c*) and 2(*d*) show opening of the vent by pivoting about the left hand vertical edge and right hand vertical edge respectively. In the former case the two stays 21 and 22 at the left hand edge remain virturally unextended and only the stays 23 and 24 at the right hand edge are extended. The necessary pivotal movement at the left hand edge of the assembly is provided partly by freedom in the pivotal connections between the bars 30 and the vent frame, and partly by flexing of the elements of the stays.

In order to provide greater ventilation, the vent may be displaced bodily away from the fixed frame at the same time as being tilted, as indicated diagrammatically in FIGS. 2(*e*) to 2(*h*). For example, in the position shown in FIG. 2(*e*) all stays are extended but the upper stays 21 and 13 are extended to a lesser extent than the stays 22 and 24.

It will be appreciated that, if required, the four stays 21, 22, 23 and 24 may be extended individually, bound only by the plane of rigidity of the vent or the frame, to any degree within the permitted range so that, in practice, the vent can be left in any angular position both vertically and horizontally within the permitted range of movement, and FIG. 2(*i*) shows an arrangement in which all four stays have a different degree of extension.

When all four stays are at their maximum extension the vent 15 will be parallel to the fixed frame and sufficiently spaced from the frame to permit easy access to both sides of the glass of the vent, for cleaning.

If the vent is required to be angled with respect to the fixed frame when it is at its maximum displacement therefrom, this may be achieved by providing upper stays of greater or less maximum extension than the lower stays, or by spacing the upper stays a different distance below the upper frame member compared to the spacing of the lower stays above the lower frame member.

As is well known, each stay is frictionally restrained by virtue of the frictional engagement between the slider 26 and the track 25. Such frictional engagement may be adjusted by means of an adjustment screw which is provided on the slider and adjustment of which varies the frictional engagement between the slider and the track.

Although the provision of four stays will be suitable for most sizes of vent in normal use, the number of stays may be increased, if required, in order to support a particularly heavy and large vent. Thus three or more stays may be provided at each side of the assembly.

Although the illustrated arrangement is preferred where the stays are mounted at the vertical sides of the assembly, a similar effect may be obtained by mounting the stays on the horizontal sides of the assembly or by mounting stays on both the vertical and horizontal sides. In the case where stays are mounted on the horizontal sides, however, the weight of the vent may lead to downward deflection of the stays.

The geometry of the conventional stays shown in the example is such that, in the case of a vertical window, the vent moves substantially horizontally towards and away from the fixed frame, and this arrangement is preferred. However, in some cases the geometry of the stays may be such that the vent moves slightly upwardly or downwardly as it is moved away from the fixed frame and it will be appreciated that in this case either the closing or opening of the window will be assisted to a certain extent by the weight of the vent.

Although it is convenient to use the known form of stay described above, since such stays are already widely available and comparatively cheap, it will be appreciated that any other appropriate form of linkage may be used instead. For example, each linkage could be a conventional "lazy tongs" arrangement.

I claim:

1. A window assembly comprising a rectangular open frame which, in use, is fixed; a rectangular vent frame which is movable into and out of engagement with the open frame; and four extensible linkages connecting the vent frame to the open frame, which linkages are symmetrically disposed on each of two opposite sides of the assembly, each linkage comprising a track mounted on a side member of one of the frames so as to extend longitudinally thereof, a slider movable along the track, a strut pivotally connected to the track, a brace pivotally connected between the slider and the strut, a link pivotally connected to the slider, and a bar pivotally connected between the link and the strut and pivotally connected at its end to a side member of the other of the frames, whereby the vent may be selectively adjusted angularly with respect to the frame by differential extension of at least certain of the linkages.

2. A window assembly according to claim 1, wherein the linkages are vertically spaced on the two vertical sides of the assembly.

3. A window assembly according to claim 1, wherein at least some of the linkages are frictionally restrained.

* * * * *